US010660435B2

(12) United States Patent
Miller, Jr. et al.

(10) Patent No.: US 10,660,435 B2
(45) Date of Patent: May 26, 2020

(54) IN-DOOR COOLER RACK SHELVING SYSTEM

(71) Applicant: Sungal Corporation, Westport, CT (US)

(72) Inventors: Donald J. Miller, Jr., Belleville, IL (US); Yeyang Sun, Westport, CT (US)

(73) Assignee: SUNGAL CORPORATION, Westport, CT (US)

( * ) Notice: Subject to any disclaimer, the term of this patent is extended or adjusted under 35 U.S.C. 154(b) by 0 days.

(21) Appl. No.: 16/271,108

(22) Filed: Feb. 8, 2019

(65) Prior Publication Data

US 2019/0239641 A1 Aug. 8, 2019

Related U.S. Application Data

(60) Provisional application No. 62/627,829, filed on Feb. 8, 2018.

(51) Int. Cl.
*A47B 57/04* (2006.01)
*A47B 96/02* (2006.01)
(Continued)

(52) U.S. Cl.
CPC ..... *A47B 57/04* (2013.01); *A47B 47/027* (2013.01); *A47B 96/021* (2013.01); *F25D 25/02* (2013.01); *F25D 2325/023* (2013.01)

(58) Field of Classification Search
CPC ..... A47B 57/04; A47B 57/16; A47B 57/20; A47B 57/40; A47B 57/404; A47B 57/48;
(Continued)

(56) References Cited

U.S. PATENT DOCUMENTS 754,817 A * 3/1904 Schriefer ..... A47B 57/16 108/109
898,970 A * 9/1908 Cook ..... A47B 57/04 108/1
(Continued)

FOREIGN PATENT DOCUMENTS

DE 2336476 A1 * 2/1975 ..... A47B 57/485
DE 3030264 A1 * 2/1982 ..... A47B 57/20
(Continued)

*Primary Examiner* — Stanton L Krycinski
(74) *Attorney, Agent, or Firm* — Ohlandt, Greeley, Ruggiero & Perle, L.L.P.

(57) ABSTRACT

Disclosed are rack shelving systems in-door coolers. The rack shelving systems are easily adjusted height-wise between adjacent shelves and can also be quickly adjusted between a flat shelf configuration and a gravity-feed configuration due to the configuration of different length prongs the attach the shelves to uprights that may have an angled surface with a hem be of a or typical U-shape. The rack shelving systems are also expandable width-wise to accommodate any number of cooler doors due to two rows of parallel slots on each upright that are configured to accept the prongs of shelves attached to adjacent uprights. The rack shelving systems very simple in design and are made up of as few as three (3) different parts: uprights, shelves, and cross-member. The rack shelving systems preferably further include feet/wheels for support and mobility.

25 Claims, 20 Drawing Sheets

(51) Int. Cl.
*F25D 25/02* (2006.01)
*A47B 47/02* (2006.01)

(58) Field of Classification Search
CPC ... A47B 57/482; A47B 57/485; A47B 57/487; A47B 96/021
USPC ..... 211/186
See application file for complete search history.

(56) References Cited

U.S. PATENT DOCUMENTS 1,366,743 A * 1/1921 O'Connor ..... A47B 47/021 108/107
1,577,066 A * 3/1926 Medart ..... A47B 57/40 108/109
3,039,621 A * 6/1962 Pilcher ..... A47B 57/485 108/107
3,111,915 A * 11/1963 Gray ..... A47B 57/04 108/6
3,120,199 A * 2/1964 Kolster ..... A47B 57/04 108/6
3,232,442 A * 2/1966 Wilson ..... A47F 5/01 211/133.2
3,304,893 A * 2/1967 Stromquist ..... A47B 55/02 108/146
3,343,506 A * 9/1967 Buchbinder ..... A47B 57/16 108/107
3,487,951 A * 1/1970 Beltzung ..... A47F 5/13 211/133.2
3,499,539 A * 3/1970 Fisher ..... A47B 81/007 211/59.2
3,705,654 A * 12/1972 Barrineau ..... A47B 57/20 211/187
4,231,301 A * 11/1980 Barrineau ..... A47B 57/20 108/110
4,240,764 A * 12/1980 Wegner ..... A47B 57/485 403/252
4,250,815 A * 2/1981 Swanson ..... A47F 5/13 108/108
4,292,902 A * 10/1981 Barrineau ..... A47F 5/13 108/110
4,391,378 A * 7/1983 Secon ..... A47F 5/13 108/109
4,405,052 A * 9/1983 Spiros ..... A47B 57/50 211/187
4,531,646 A * 7/1985 Howard ..... A47F 5/12 108/6
4,627,542 A * 12/1986 Fredrickson ..... A47F 5/12 211/150
4,684,094 A * 8/1987 Everett ..... A47B 57/404 211/187
5,094,350 A * 3/1992 Smock ..... A47B 57/04 211/150
5,251,973 A * 10/1993 Hazan ..... A47B 61/00 211/186
5,415,302 A * 5/1995 Carlson ..... A47B 55/02 108/147.13
5,450,971 A * 9/1995 Boron ..... A47F 1/12 108/107
5,487,474 A * 1/1996 Heimendinger ..... A47F 1/12 211/1.57
5,607,068 A * 3/1997 Coretti, Jr. ..... A47F 5/135 211/59.2
5,622,415 A * 4/1997 Felsenthal ..... A47B 43/006 108/110
5,641,083 A * 6/1997 Metcalf ..... A47B 57/045 108/1
5,797,502 A * 8/1998 Brady ..... A47F 1/12 108/107
6,302,036 B1 * 10/2001 Carson ..... A47F 1/12 108/107
6,526,897 B1 * 3/2003 Ondrasik ..... A47B 57/20 108/107
6,729,484 B2 * 5/2004 Sparkowski ..... A47F 5/137 211/134
6,814,245 B2 * 11/2004 Leclerc ..... A47B 47/021 108/107
6,817,478 B2 * 11/2004 Venegas, Jr. ..... A47F 5/137 211/182
6,871,747 B2 * 3/2005 Bustos ..... A47F 5/01 211/118
6,920,831 B2 * 7/2005 Lin ..... A47B 57/40 108/107
6,971,528 B2 * 12/2005 Chen ..... A47B 57/40 211/182
7,128,221 B2 * 10/2006 Metcalf ..... A47F 5/137 211/59.2
7,246,711 B1 * 7/2007 Metcalf ..... A47B 45/00 211/106.01
7,533,948 B2 * 5/2009 Smith ..... A47B 55/02 108/107
8,020,714 B2 * 9/2011 Miller, Jr. ..... A47F 3/0404 108/107
8,196,761 B2 * 6/2012 Morandi ..... A47B 96/021 108/181
9,004,300 B1 * 4/2015 Morrell ..... A47F 5/137 108/107
9,215,926 B1 * 12/2015 Offerman ..... A47B 47/02
9,247,834 B1 * 2/2016 Lucht ..... A47F 5/13
9,357,840 B2 * 6/2016 Davis ..... A47B 57/04
9,878,649 B2 * 1/2018 Beere ..... B60N 3/001
9,936,825 B1 * 4/2018 Lindblom ..... A47F 5/0087
10,165,854 B2 * 1/2019 Lim ..... A47B 47/0091
10,299,588 B1 * 5/2019 Lai ..... A47B 95/00
2004/0251226 A1 * 12/2004 Yang ..... A47B 57/40 211/187
2005/0127802 A1 * 6/2005 Chen ..... A47B 57/36 312/265.4
2007/0110511 A1 * 5/2007 Chen ..... A47B 95/04 403/230
2007/0295681 A1 * 12/2007 Colin ..... A47F 5/12 211/90.03
2008/0142463 A1 * 6/2008 Johnson ..... A47B 57/20 211/187

FOREIGN PATENT DOCUMENTS

DE 29712455 U1 * 9/1997 ..... A47B 96/06
DE 19625476 A1 * 1/1998 ..... A47B 87/008
DE 202018105681 U1 * 10/2018 ..... A47B 96/06
FR 3002838 B1 * 12/2015 ..... A47B 96/1475
GB 766411 A * 1/1957 ..... A47B 57/04
GB 816356 A * 7/1959 ..... A47B 57/485
GB 1180043 A * 2/1970 ..... A47B 57/425

* cited by examiner

IN-DOOR COOLER RACK SHELVING SYSTEM

BACKGROUND

1. Field of the Disclosure

The present disclosure relates generally to rack shelving systems. More particularly, the present disclosure relates to rack shelving systems for in-door coolers.

2. Description of Related Art

Items, such soda, beer and water are frequently displayed in rows in refrigerated coolers having doors that may either slide or rotate to open to provide access to the interior of the cooler and to the refrigerated item. Generally, the state-of-the-art shelving systems that hold and display the refrigerated items are in a relatively "fixed" configuration, i.e., either flat or gravity-feed shelves, so that converting from one configuration to the other is difficult and time-consuming. Moreover, the state-of-the-art shelving systems that hold and display the refrigerated items are also in a relatively "fixed" configuration with respect to the height between adjacent shelves, making adjustment thereof also difficult and time-consuming. Finally, the state-of-the-art shelving systems that hold and display the refrigerated items are also in a relatively "fixed" position with respect to the doors, i.e., the shelving systems are connected in some manner to the frames holding the doors.

In addition, state-of-the-art shelving systems have several undesirable design features. These undesirable features include: (1) the use of uprights that are closed on all sides, (2) unmarked slots for shelf placement that are disposed 1.5 inches on center, (3) shelves and/or uprights that are generally affixed to the frames of the cooler, and (4) utilize single prongs for the attachment of the shelves to the uprights. This combination of features of uprights and shelves of the state-of-the-art shelving systems limits the versatility of the systems, renders assembly and installation more time-consuming, and does not provide sufficient stability to the shelves when installed in the uprights.

The present disclosure provides in-door cooler rack shelving systems that overcome the above disadvantages of the state-of-the-art cooler shelving systems. The in-door cooler rack shelving systems of the present disclosure provide systems having fewer parts that are simple to assemble, yet flexible enough to accommodate both flat and gravity-feed configurations, as needed, as will be explained more in the detailed description that follows.

SUMMARY

The in-door cooler rack shelving systems of the present disclosure are easily adjusted height-wise between adjacent shelves as desired and can also be quickly adjusted between a flat shelf configuration and a gravity-feed configuration. The in-door cooler rack shelving systems of the present disclosure are also expandable width-wise to accommodate any number of cooler doors as may be desired or necessary. The in-door cooler rack shelving systems of the present disclosure are made up of as few as three (3) different parts: uprights, cross-members connected to the uprights, and shelves. The rack shelving systems preferably further include feet/wheels for support and mobility. The in-door cooler rack shelving systems of the present disclosure provide flexibility in configuring an in-door cooler shelving installation to accommodate any arrangement of packaging without needing to reconfigure, or disassemble and re-assemble, the shelving installation.

The in-door cooler rack shelving systems of the present disclosure provide a combination of features that are distinct from the state-of-the-art shelving systems and provide solutions to the above-indicated shortcomings. In accordance with the in-door cooler rack shelving systems of the present disclosure, the slots are disposed on approximately ¾" inch centers, thereby providing improved adjustability for each shelf. In addition, the uprights used in the in-indoor cooler rack shelving system of the present disclosure are open on one side to meet NSF guidelines. That is to say, being open on one side, the uprights according to the present disclosure are easier to clean and less likely to provide a source of contamination. Still further, the in-indoor cooler rack shelving systems of the present disclosure are free-standing, which allows the shelving system to be set back from the door of the cooler itself. This provides the benefit of allowing additional light to enter the center of the door and illuminate merchandise. Another advantage of the in-indoor cooler rack systems of the present disclosure is that there are eight (8) prongs disposed on the shelves, two prongs on each corner, front and rear. This provides additional stability to the shelves and reduces the risk of racking (i.e., lateral and/or front-to-back movement) of the wire shelf when pushed or hit. Still further, with respect to the shelves of the in-door cooler rack systems of the present disclosure, the upper front prongs (i.e., the front prong closer to the shelf surface on each side of the shelf) is longer, preferably about an inch longer, than the lower front prong and both rear prongs. This configuration allows the shelf to be moved backwards for changing the placement of the rear prongs, up or down, without disengaging the longer front prongs. This also makes it easier to install the shelf, as you only need to align two front prongs with the slots and then slide the shelf forward which automatically lines up the rear prongs with slots. This configuration also allows for the shelves of the in-door cooler rack systems of the present disclosure to be changed from a flat configuration to an inclined configuration, or vice versa, very easily. Another feature of the in-door cooler rack systems of the present disclosure is that the slots on the uprights are numbered so that installation is faster and more accurate, and the installer setting the shelves can follow a shelving planogram without needing to know which product is to be placed on the shelves. The in-door cooler rack systems of the present disclosure also are freestanding and can be assembled without the need of any tools or hardware.

One embodiment of the present disclosure relates to an in-door cooler rack shelving system comprising: at least four uprights comprising a pair of front uprights and a pair of rear uprights, wherein each upright comprises a plurality of openings arranged in a row along a length of a surface of each upright; at least four cross-members, wherein two cross-members are disposed between a first front upright and a first rear upright and wherein two cross-members are disposed between a second front upright and a second rear upright; and at least one wire shelf having a substantially planar configuration with a top surface and a bottom surface, wherein the wire shelf is comprised of a plurality of longitudinal wires; and a plurality of prongs disposed away from the bottom surface, wherein each prong is sized and configured to engage an opening in the first pair of uprights or the second pair of uprights.

Preferably, each upright has a keyhole disposed on at least one side of the upright adjacent to the openings, wherein the keyhole is designed and configured to accept or connect to a protrusion on a cross-member. Also, preferably, one cross-member each is disposed proximal top or proximal a bottom between each pair of front uprights and rear uprights upright, and also preferably, the cross-members are of a substantially equal length. The system may further comprise at least two support wires disposed below and substantially perpendicularly to the plurality of longitudinal wires, wherein the support wires have first end and a second end, and a prong is disposed at each of the first end and the second end of each of the at least two support wires. Also, preferably the prongs engage the openings of the uprights so that the wire shelf provides a width distance there-between. Preferably, the keyhole and/or the plurality of openings is sized and configured to matingly engage a protrusion on each end of the cross-members and the plurality of openings has a shape selected from the group consisting of oval, square and circular. Also, preferably the plurality of openings is arranged in two parallel rows along the length of each upright, and the openings in each parallel row are spaced substantially equally from each adjacent opening is the row. Preferably, at least some of the openings are identified with a marking and, also preferably, openings at the same position along the length of each parallel row are identified with the same marking. Preferably also, adjacent openings are spaced approximately ¾" on center. The protrusion on the cross-members is preferably selected from the group consisting of a spring-loaded clip, a raised tab disposed on a post and a lock tab. Also, an end of each upright further comprises a support selected from the group consisting of an adjustable foot, a roller and a wheel. Preferably also each upright comprises a "C"-shaped open tubular configuration. Preferably, the prongs disposed on the support wires proximal the bottom surface and/or a front of the wire shelf are longer than the prongs disposed on the support wires distal the bottom surface and/or proximal a rear of the wire shelf. The systems preferably further comprise a second prong disposed below and parallel to each prong disposed at the first and second ends of the at least two support wires. The second prong may comprise an extension attached to the first and second ends of the at least two support wires, wherein the extension is reinforced. Also, preferably the prongs are angled downwardly away from the bottom surface of the wire shelf. Preferably, the system further comprises a cross-brace disposed between the first and second front upright and/or between the first and second rear upright.

DETAILED DESCRIPTION OF THE PREFERRED EMBODIMENT

Preferred embodiments of the present disclosure, as well as options thereof, will now be described in conjunction with the Figures, in which like numerals denote like elements.

Figure 1:
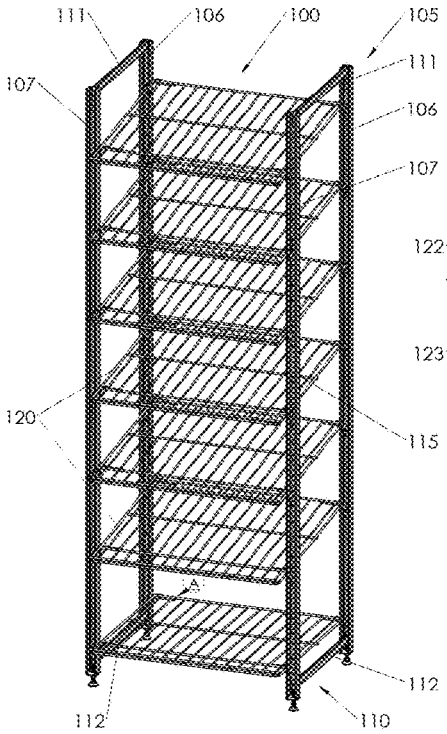
FIG. 1 shows an overhead front perspective view of an assembled in-door cooler rack shelving system according to the present disclosure.

FIG. 1 shows an assembled in-door cooler rack shelving system ("system") 100 comprised of a plurality of uprights 105. In the embodiment shown in FIG. 1, system 100 includes four (4) uprights 105 (i.e., a pair of rear uprights 106 and a pair of front uprights 107), four (4) cross-members 110 (i.e., a pair of upper cross-member 111 and a pair of lower cross-member 112), and a plurality of wire shelves 120. Although both rear and front uprights 106, 107 are identical, different designators for each at times may be used herein for clarity of description, as may be necessary. One rear upright 106 is connected to one front upright 107 with one upper cross-member 111 and one lower cross-member 112. Again, although both upper and lower cross-member 111, 112 are identical, different designators for each at times may be used herein for clarity of description, as may be necessary. Each upright 105 has rows of slots 115 (see, FIG. 1A) along its length that are disposed and configured to engage other elements of system 100, as will be described below. In the embodiment shown in FIG. 1A, slots 115 are generally oval in shape, although other shapes such as circular or square may be used. Preferably, each upright 105 has two parallel rows of slots 115 disposed along its length on one side thereof and, also preferably, each of slots 115 in the two parallel rows of slots 115 is evenly spaced apart from each vertically spaced (i.e., along the length of upright 105) adjacent slot 115. Also, preferably slots 115 are identified by some marking, such as numbers 116, so that proper placement of the other elements of system 100 engaged with slots 115 can be performed quickly, accurately and correctly. In the embodiment shown in FIGS. 1 and 1A, every other slot 115 is marked with numbers 116 on a flat section 164 (see, FIG. 1C) of each upright. Also, in the embodiment shown in FIG. 1, upper cross-member 111 is attached to top slots 115 of rear and front upright 106, 107 and lower cross-member 112 is attached to slots 115 approximately 6" from the floor (generally in the first slots 115 available in each of rear upright 106 and front upright 107) to provide ease of access for mopping and cleaning. Each of the plurality of wire shelves 120 is attached to each rear upright 106 and each front upright 107 using prongs 130, 131 (see, FIG. 1A) to engage slots 115, as will be further described below.

Figure 1A:
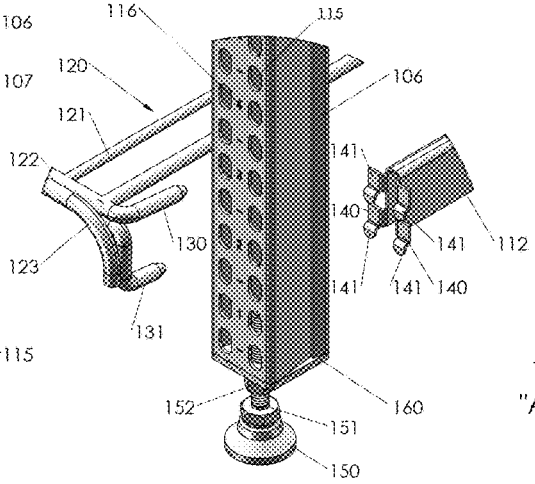
FIG. 1A shows a detailed and exploded rear view of section "A" of FIG. 1.
Figure 1B:
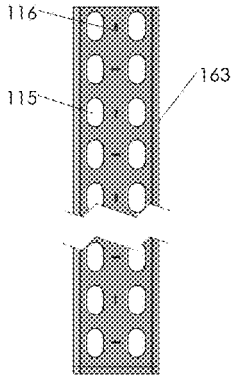
FIG. 1B shows a front view, with break lines, of a portion of an upright of an in-door cooler rack shelving system according to the present disclosure.

Uprights 105 can be provided in any height (or length) as necessary. As mentioned above, in the embodiment shown, each upright has two parallel rows of slots 115 disposed on a surface thereof (see, FIG. 1A). Also, as mentioned above each slot 115 in the embodiment shown in FIGS. 1A and 1B is substantially oval in size, i.e. having a dimension in a vertical direction (parallel to the length of upright 105) that is greater than the dimension in a horizontal direction (perpendicular to the length of upright 105). In the embodiment shown in Figures, each slot 115 is separated by a length of ¾-inch on center from each adjacent vertically disposed slot 115. The ¾-inch center-to-center distance between vertically disposed slots 115 provides double the number of slots 115 as available on state-of-the-art cooler shelving systems. This, in turn, provides increased adjustability of spacing between adjacent wire shelves 120 in the system 100 of the present disclosure. This, in turn, reduces wasted vertical space thus allowing for an increased amount of merchandise to be placed in the same vertical space as state-of-the-art cooler shelving systems. As shown in FIGS. 1A and 1B, each upright 105 also includes numbers 116 that allow simple and fast insertion of wire shelves 120 into the correct vertical locations on uprights 105. Numbers 116 avoid errors in wire shelf 120 placement and also allow the installer to follow the merchandise planogram based on package heights without needing to know which merchandise is to be placed on which wire shelf 120. FIG. 1A shows an exploded view of the rear side of system 100 as indicated at "A" in FIG. 1, including rear upright 106, lower cross-member 112 and wire shelf 120. Wire shelf 120 comprises a plurality of longitudinal wires 121, a plurality of support wires 122, curved support brace 123, upper prong 130 and lower prong 131 which will be described in more detail with respect to FIG. 2. Lower cross-member 112 is shown in FIG. 1A (but each upper and lower cross-member 111, 112 is identical) and includes a pair of spring-loaded clips 140 welded to lower cross-member 112. In the embodiment shown in FIG. 1A, lower cross-member 112 has the shape of an inverted "U" that prevents spillage or other debris from collecting therein. Each spring-loaded clip 140 includes a pair of spaced apart fingers 141, each of which is disposed and configured to engage a slot 115. In the embodiment shown in FIGS. 1 and 1A, fingers 141 are disposed so that they engage adjacent slots 115 (see, FIG. 3A). Fingers 141 are also slanted slightly inward (i.e., toward lower cross-member 112) to ease installation and to create a spring load on slots 115 of uprights 105 to effectively wedge cross-member 110 into slots 115 on upright 105. The attachment of cross-member 110 adds forward and backward stability to system 100 of the present disclosure because the surfaces of the ends of cross-member 110 contact the surface of uprights 105 against on the back side of front upright 107 and the front side of rear upright 106, allowing the system 100 of the present disclosure to stand without attachment to a cooler, a wall, ceiling or floor. Also shown in FIG. 1A is an adjustable foot 150 attached to a threaded rod 151 that engages a threaded opening 161 (see, FIG. 1C) in a base plate 160 welded to the bottom of each upright 105. To secure adjustable foot 150 at the desired height, one or more locking nuts 152 may be provided that locks up against the bottom side of base plate 160. As an alternative to adjustable foot 150, rollers or wheels (not shown) may be used to make moving system 100 easier.

Figure 1C:
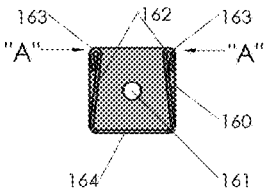
FIG. 1C shows a top view of an upright of an in-door cooler rack shelving system according to the present disclosure.

FIG. 1C shows a top view of upright 105 looking downwardly toward base plate 160 and threaded opening 161. As mentioned above, rear and front uprights 106, 107 are identical. Uprights 105 are fabricated from "C"-shaped metal open tubular stock, with each leg 162 of the "C" rolled outward into a hem 163 completely from top to bottom of upright 105. Hems 163 are sealed via force and paint to ensure NSF compliance. The total outer dimension "A"-"A" of the two legs 162 is no wider than a flat section 164 of upright 105. In the embodiment shown FIG. 1C, the finished upright 105 will preferably be 1.5" square so that it will retro-fit existing cooler door rack systems. Also, as shown in FIG. 1C, threaded opening 161 is offset from the center of base plate 160 toward flat section 164 for added stability.

Figure 1D:
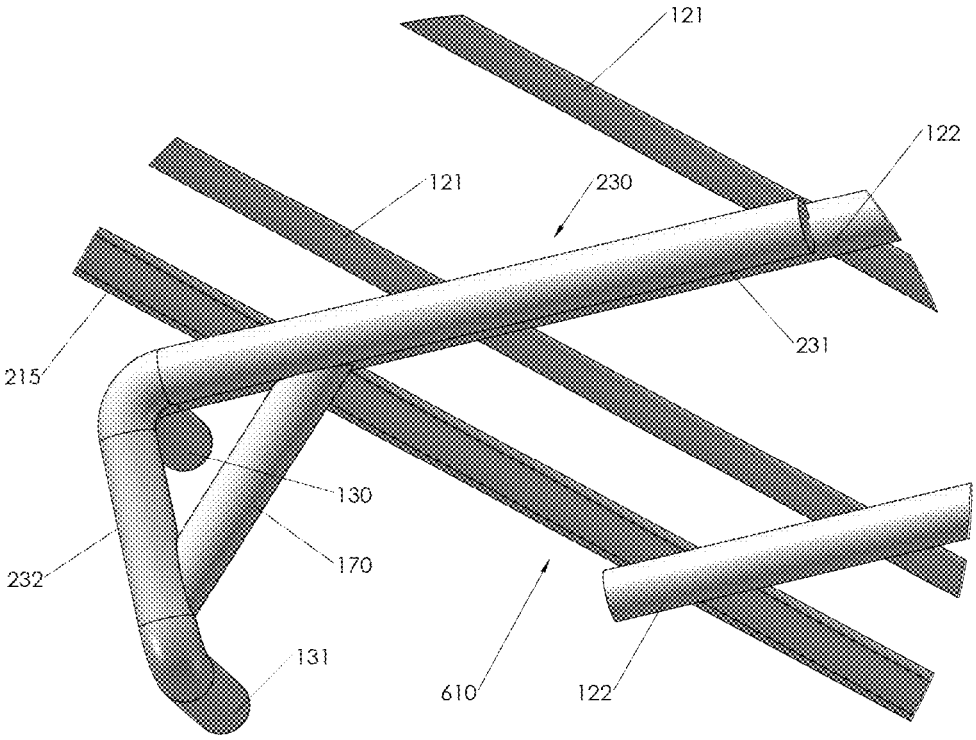
FIG. 1D shows a bottom perspective view of an alternative support mechanism for a portion of a wire shelf of an in-door cooler rack system according to the present disclosure.
Figure 6:
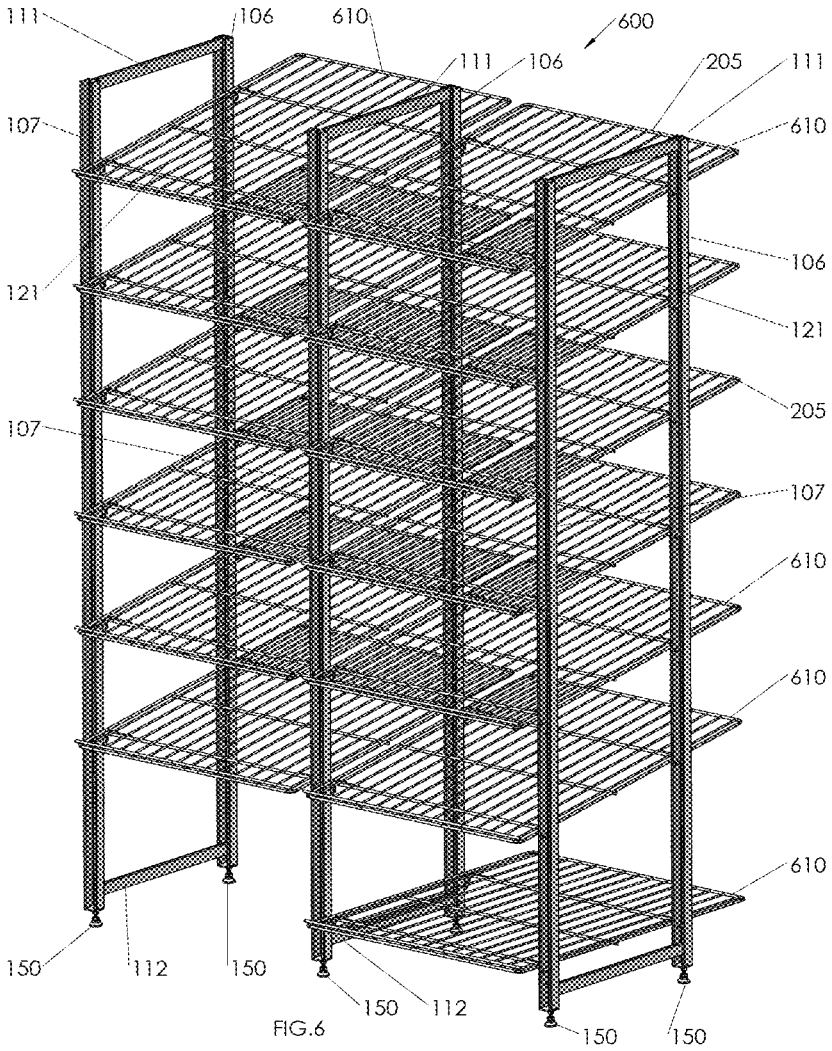
FIG. 6 shows a front perspective view of a side-by-side two shelf configuration of two assembled in-door cooler rack shelving systems according to the present disclosure, with rear shelf extensions.

FIG. 1D shows a bottom front perspective view of a section of the rear portion of an extended wire shelf 610 (see, FIG. 6). All of the elements shown in FIG. 1D have been previously described with respect to FIGS. 1-1C with the exception as follows. Rather than curved support brace 123 that is attached against extension 230 (see, FIGS. 2-2A) to support lower prong 131 in the embodiment shown in FIG. 1D, a support strut structure 170 is used. Support strut 170 is disposed between a horizontal arm 231 and a vertical arm 232 of extension 230. Support strut 170, as with curved support brace 123, provides lateral support to lower prong 131 so that it does not become misaligned and hamper engagement with slots 115.

Figure 2:
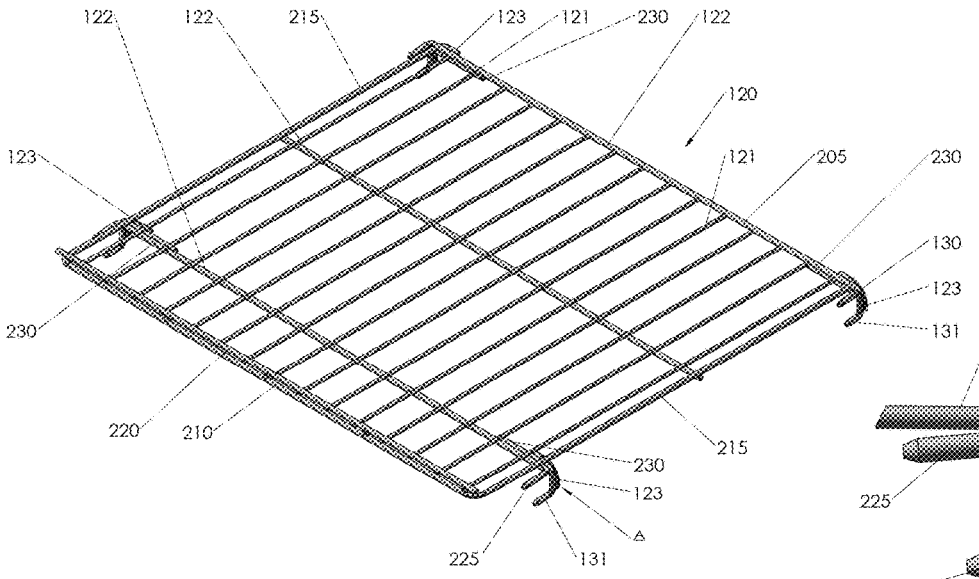
FIG. 2 shows a top front perspective view of a wire shelf of an in-door cooler rack shelving system according to the present disclosure.
Figure 2A:
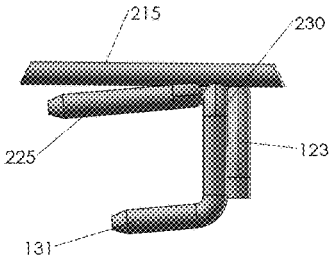
FIG. 2A shows a detailed view of section "A" of FIG. 2.

FIG. 2 shows an embodiment of wire shelf 120 according to the present disclosure. Wire shelf 120 includes a plurality of longitudinal wires 121 (i.e. wires disposed from a rear edge 205 to a front edge 210 of wire shelf 120) and a plurality of support wires 122 disposed substantially perpendicular to longitudinal wires 121. Wire shelf 120 includes two side wires 215 and a front stop 220. Front stop 220 is particularly useful in those installations of systems 100 where gravity feed and/or roller shelves are employed to advance merchandise from rear edge 205 to front edge 210. As mentioned above with respect to the discussion of the exploded view shown in FIG. 1A, wire shelf 120 includes curved support braces 123, upper prongs 130 and lower prongs 131. Wire shelf 120 also includes an upper prong 225 disposed proximal front edge 210. Upper prongs 130, 225 are part of support wires 122 in the embodiment shown in FIG. 2, but this is not required. On the other hand, in the embodiment shown in FIG. 2, lower prongs 131 are part of extensions 230 that are welded to support wires 122. Because extensions 230 may be subject to stress caused by merchandise displayed on wire shelf 120, extensions 230 are reinforced using curved support braces 123 that likewise are welded to extensions 230 or can be welded between end wires 215 and extension 230. The double prong 130, 131 and/or 131, 225 connection points on all four corners of wire shelf 120 provide lateral stability to system 100. In fact, the greater the number of wire shelves 120 installed into uprights 105, the more lateral stability provided to system 100. In the embodiment shown in FIGS. 1 and 2, upper prong 225 is about 1 inch longer than upper prongs 130 and lower prongs 131. This design is provided so that wire shelf 120 can be displaced rearwardly to disengage upper prongs 130 and lower prongs 131 while prong 225 remains engaged due to its longer length in order to move wire shelf 120 from a flat configuration to a gravity-feed configuration, or vice versa, without having to disengage the entire shelf. At the same time, markings remain visible to the user so as to ease placement of wire shelf 120 at the correct/desired level. As mentioned above, this also makes it easier to install the shelf, as you only need to align two upper prongs 225 with the slots and then slide the shelf forward which automatically line up the rear prongs with slots. Also, the distance between upper prong 225 and its associated lower prong 131 when upper prong 225 is engaged into a slot 115, is such that lower prong 131 will not touch the bottom of slot 115 into which it is engaged. The same spatial orientation applies to rear prongs 130, 131. This configuration reduces drag and aids installation. FIG. 2A shows a side view of upper prong 225, lower prong 131, extension 230, curved support brace 123 and side wire 215 along line "A" shown in FIG. 2. All of upper prong 225, upper prong 130 and lower prongs 131 are angled downwardly away from the bottom of wire shelves 120 to prevent wire shelves 120 from vibrating or sliding backward and possibly disengaging from slots 115 when wire shelves 120 are set in a flat configuration.

Figure 3A:
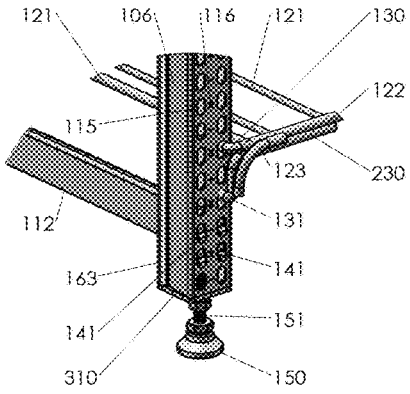
FIG. 3A shows a detailed view of section "A" of FIG. 3.
Figure 3:
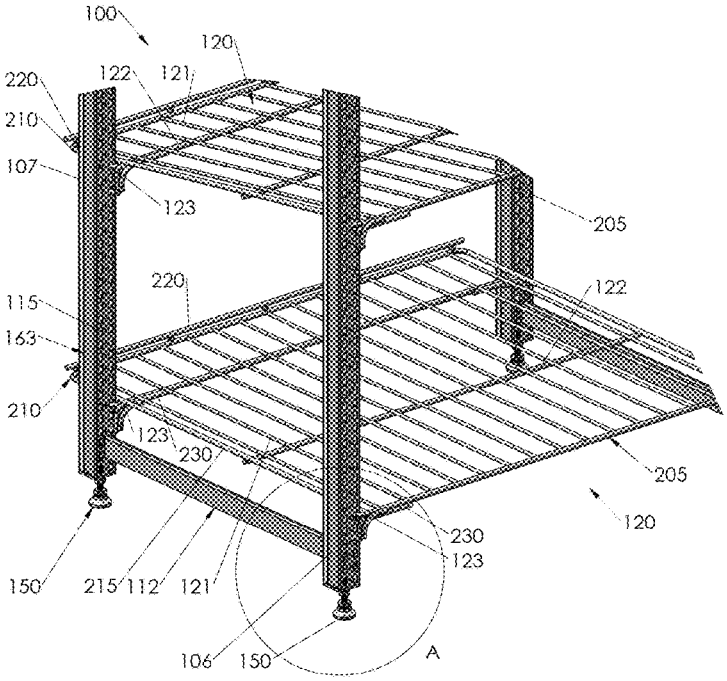
FIG. 3 shows a rear perspective view of a section of the lower portion of an assembled in-door cooler rack shelving system according to the present disclosure.

FIG. 3 shows a rear perspective view of a lower portion of system 100. In FIG. 3, all elements have been previously described with respect to FIGS. 1, 1A and 2. In FIG. 3, upper wire shelf 120 is disposed at a decline (from rear 205 edge to front edge 210) as is also shown in FIG. 1. Because the plurality of longitudinal wires 121 are disposed at the decline from rear edge 205 to front edge 210 of wire shelf 120, and are also disposed above support wires 122, longitudinal wires 121 present a relatively smooth surface such that merchandise can move smoothly by gravity from rear edge 205 to front page 210. FIG. 3A shows a detailed view of section "A" of FIG. 3. As shown in FIG. 3A, fingers 141 of spring-loaded clip 140 (not shown in FIG. 3A) occupy adjacent slots 115 proximal a lower end 310 of rear upright 106. Also, as shown in FIG. 3A prongs 130, 131 occupy slots 115 such that an empty slot 115 is there-between. Of course, the positioning of fingers 141 and/or prongs 130, 131 in relation to slots 115 is a matter of design choice. As can be seen, numbers 116 are disposed on uprights 105 and face the "rear" (away from cooler door) of system 100. This is so a user can see the positioning of wire shelf 120 according to the Planogram, as well as to ease movement of wire shelf 120 from a flat configuration to a gravity-feed/inclined configuration. Movement of wire shelf 120 is accomplished by sliding wire shelf 120 toward the "rear" of system 100. Sufficient movement cause al prongs 130, 131 to be removed from slots 115, but longer upper prong 225 remains in slot 115, thereby allowing the angel (flat/inclined) of wire shelf 120 to be adjusted without removing wire shelf 120 completely from system 100.

Figure 4:
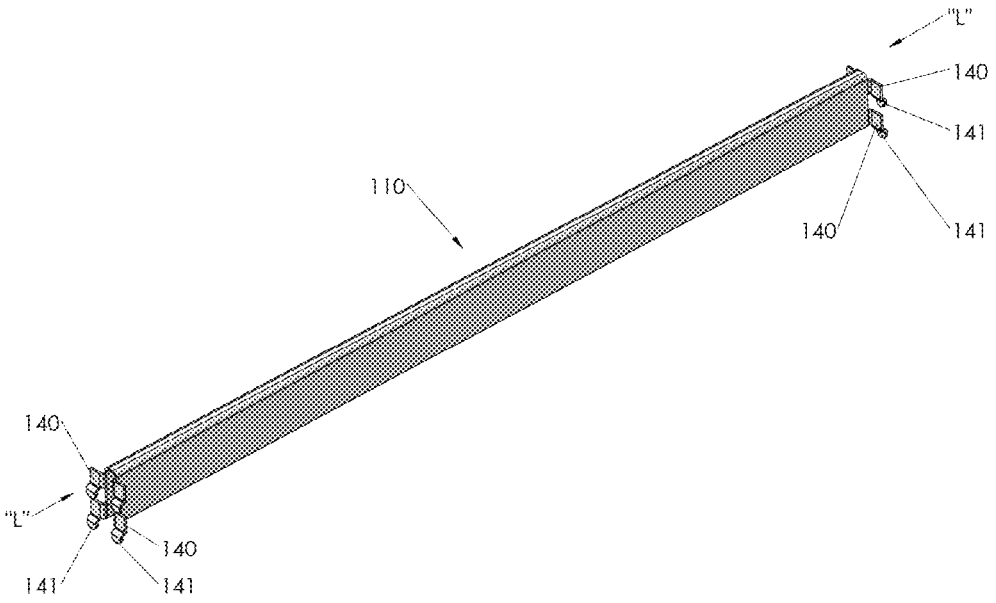
FIG. 4 shows a perspective view of a cross-member of an in-door cooler rack shelving system according to the present disclosure.

FIG. 4 shows a perspective view of cross-member 110. As previously described, cross-member 110 is made of an inverted "U"-shaped extruded metal. Cross-member 110 may have any length "L", as desired, to provide the desired distance between rear upright 106 and front upright 107 and the desired dimension between rear edge 205 and front edge 210 of wire shelf 120. Also, as previously described, on each end of cross-member 110 is a plurality of spring-loaded clips 140, with each spring-loaded clip 140 having a finger 141 associated therewith. Spring loaded clips 140 shown in FIG. 4 comprise four (4) separate spring-loaded clips 140, each having a finger 141 associated therewith. However, other configurations are possible, such as two (2) spring-loaded clips 140, one each welded to a leg of the inverted "U". In this latter configuration, each spring-loaded clip 140 will preferably have two (2) fingers 141, an upper finger 141 and a lower finger 141. Of course, fewer spring-loaded clips 140 can be used, though this is not preferred.

Figure 4A:
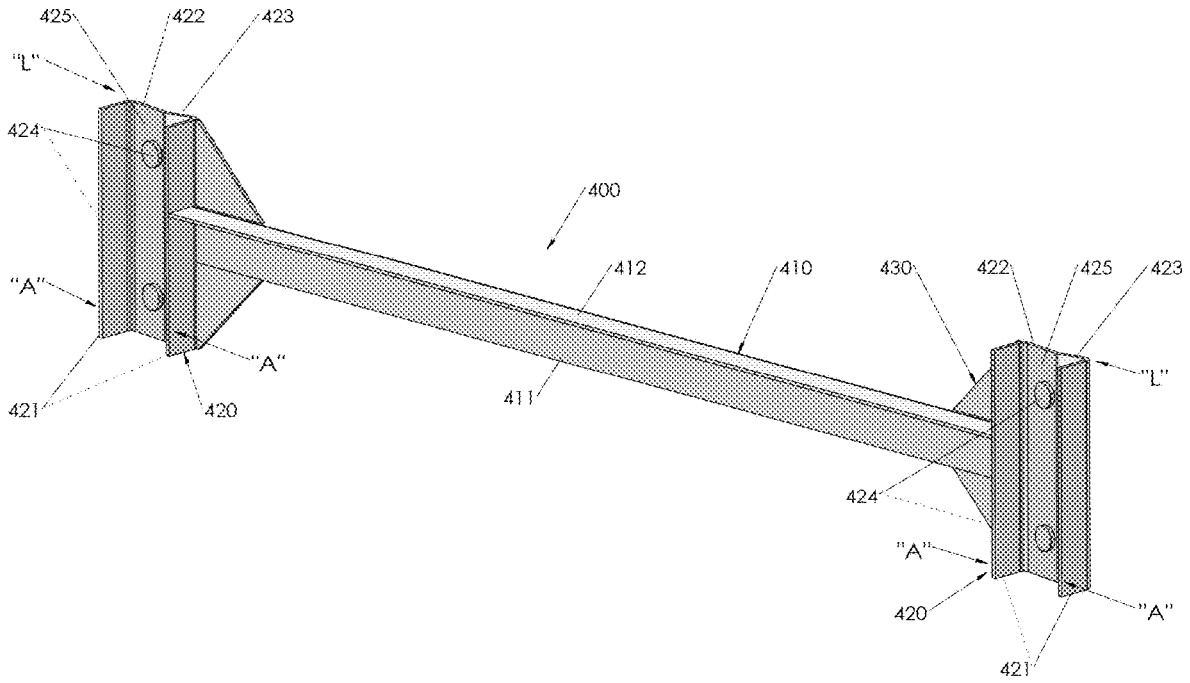
FIGS. 4A-4C show a second embodiment of a cross-member of an in-door cooler rack shelving system according to the present disclosure and its placement on an alternative upright.

FIG. 4A shows a second embodiment of a cross-member 400 suitable for use in conjunction with uprights 105 of the present disclosure. Cross-member 400 comprises a cross-bar 410, a pair of flanged end members 420, and a plurality of support elements 430. As shown in FIG. 4A, cross-bar 410 is an "L"-shaped member comprised of a vertical portion 411 and a horizontal portion 412, with vertical portion 411 and horizontal portion 412 substantially perpendicular to each other. Of course, cross-bar 410 can have any other shape than "L"-shaped such as, for instance, a vertical portion 411 or horizontal portion 412 alone, circular, oval, square, and the like. Each flanged end member 420 comprises a pair of surrounds 421, a first angled surface 422, a second angled surface 423, and a pair of raised tabs 424. The function of each flanged end member 420, surround 421, first angled surface 422, second angled surface 423, and raised tab 424 be further explained in conjunction with FIGS. 4B-4C. However, it should be noted that one of the pair of surrounds 421 may be omitted and one of the pairs of raised tabs 424 may be omitted, although the function of flanged end members 420 may be reduced thereby. Each raised tab 424 is set away from the inside surface 425 of first angled surface 422 on a post (not shown) which will be understood from the description of FIGS. 4B-4C that follows. As shown in FIG. 4A, pair of surrounds 421, when used, is separated by a distance "A"-"A" that is sized and configured to accept and surround the total dimension of the combination of leg 162 and hem 163, as a be further discussed in conjunction with FIGS. 4B and 4C. Support elements 430 are provided to reduce racking of wire shelf 120 and/or uprights 105. Support elements 430 can be omitted or reduced in number from the four shown in FIG. 4A. Length "L" serves the same purpose as length "L" of FIG. 4.

Figure 4B:
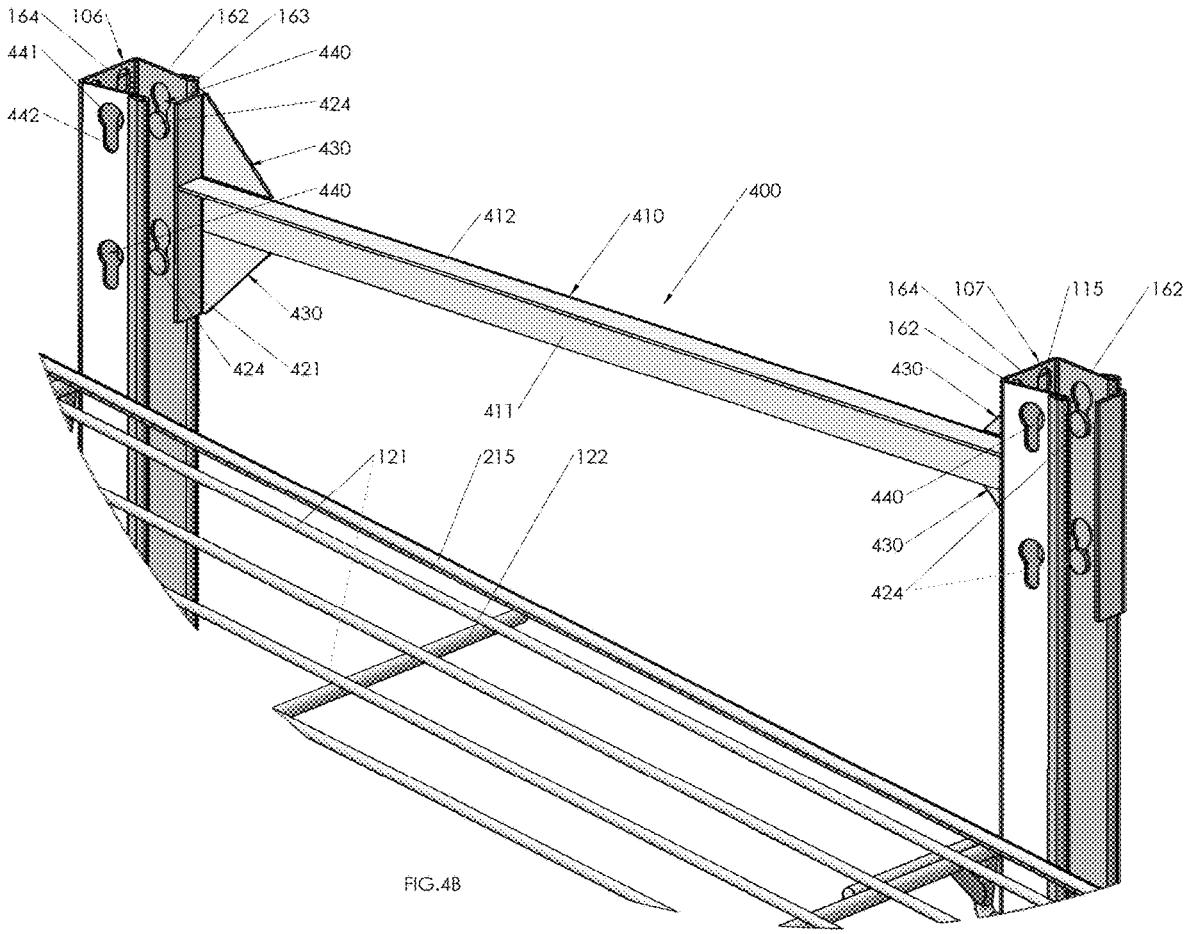
Figure 4C:
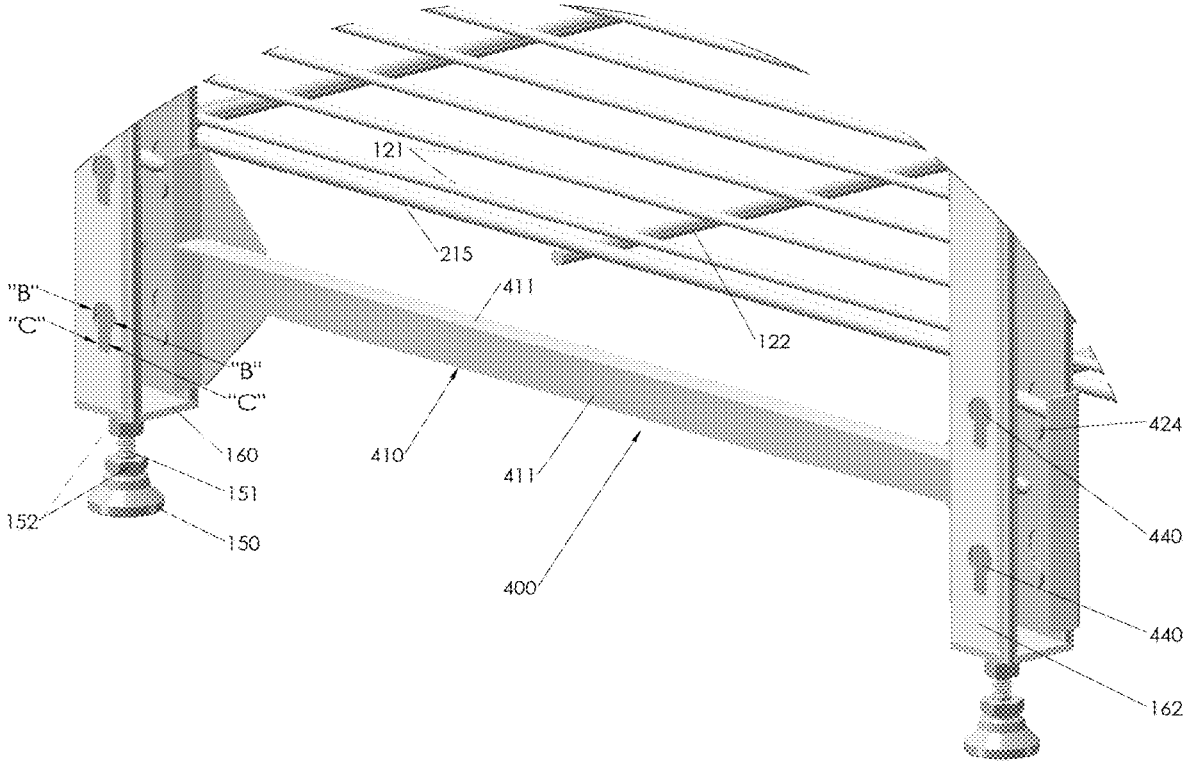

FIGS. 4B-4C show cross-member 400 in place on rear upright 106 and front upright 107. In FIG. 4B, each of rear upright 106 and front upright 107 has been modified to include a plurality of keyholes 440. Each of rear upright 106 and front upright 107 includes a pair of keyholes 440 disposed on each leg 162. This configuration is provided in the embodiment shown in FIG. 4B so that rear upright 106 and/or front upright 107 can be used as an end or internal upright 105 (see, e.g., FIG. 5) and/or that cross-member 400 can be placed on the outside or on the inside of uprights 105. Each keyhole 440 comprises an upper opening 441 and a lower opening 442 that are connected to each other. Upper openings 441 are sized and configured to accept raised tabs 424, while lower openings 442 are sized and configured to accept a post (not shown) that attaches raised tab 424 to cross-member 400 and is a smaller dimension than raised tab 424. Cross-member 400 is connected to rear upright 106 and front upright 107 by placing raised tabs 424 into upper openings 441 and sliding cross-member 400 in a direction so that the post (not shown) engages lower opening 442. As shown in FIG. 4B, upper opening is circular shaped (except where it meets the connection with lower opening 442) and lower opening 442 is oval or "race-track" shaped (except where it meets the connection with upper opening 441). Of course, upper opening 441 can be any size or configuration "B"-"B" (see, FIG. 4C) sufficient to accept a largest dimension of raised tab 424. At the same time, lower opening 442 can be any size or configuration "C"-"C" (see, FIG. 4C) sufficient to accept a largest dimension of post (not shown) while also of a size or configuration to prevent raised tab 424 from pulling out therefrom. In the embodiment of cross-member 400 shown in FIGS. 4A-4C, first angled surface 422 is sized and configured so that raised tab 424 can matingly engage upper openings 441 and second angled surface 423 is sized and configured to accommodate hem 163 so that surround 421 attached to second angled surface 423 can pass around hem 163 and surround upright 105.

FIG. 4C is similar to FIG. 4B except that cross-member 400 is attached to an inside surface of upright 105, i.e. the surface of upright 105 closest to wire shelf 120.

Figure 4D:
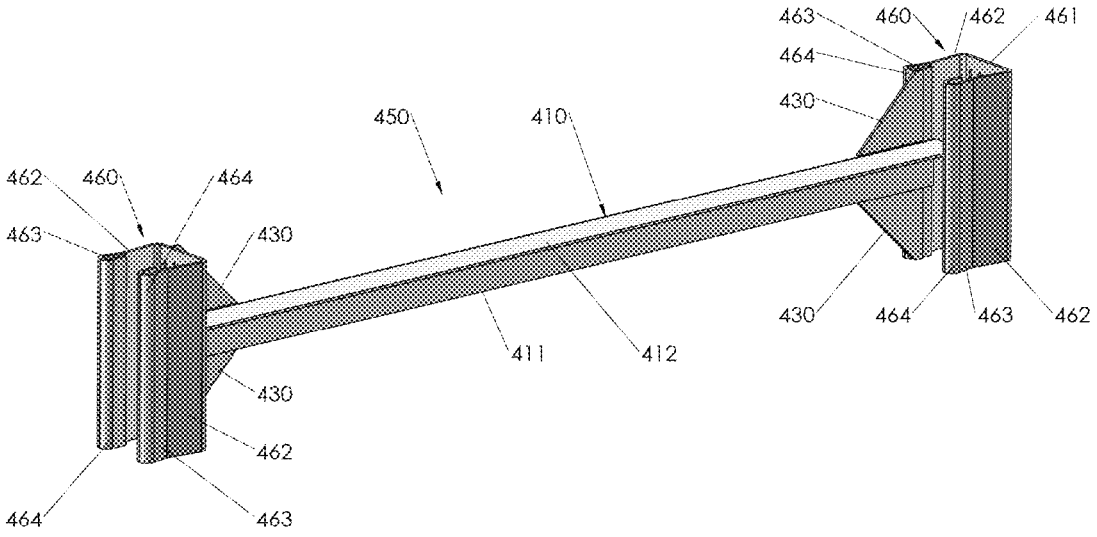
FIGS. 4D-4F show a third embodiment of a cross-member of an in-door cooler rack shelving system according to the present disclosure and its placement on the alternative upright.
Figure 4E:
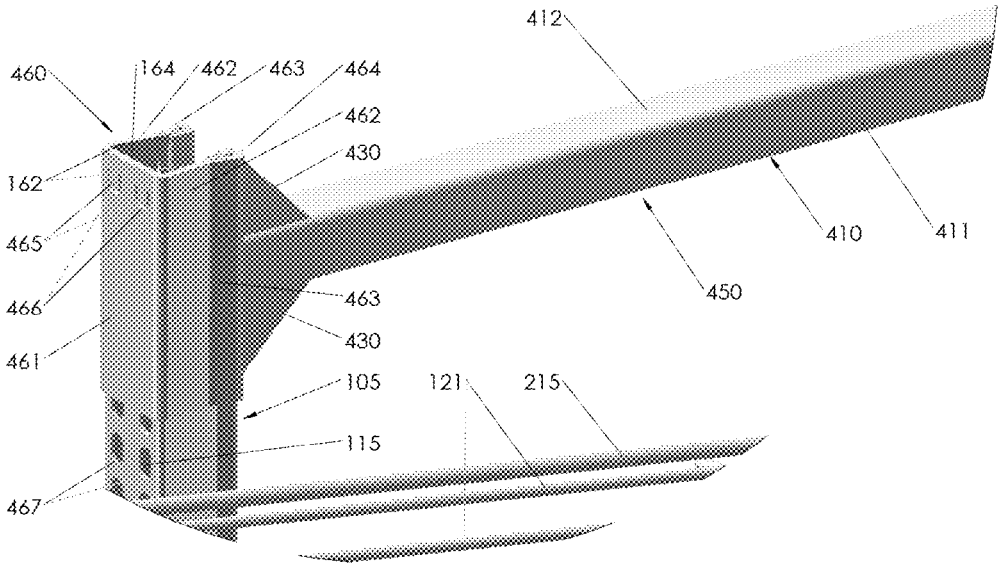
Figure 4F:
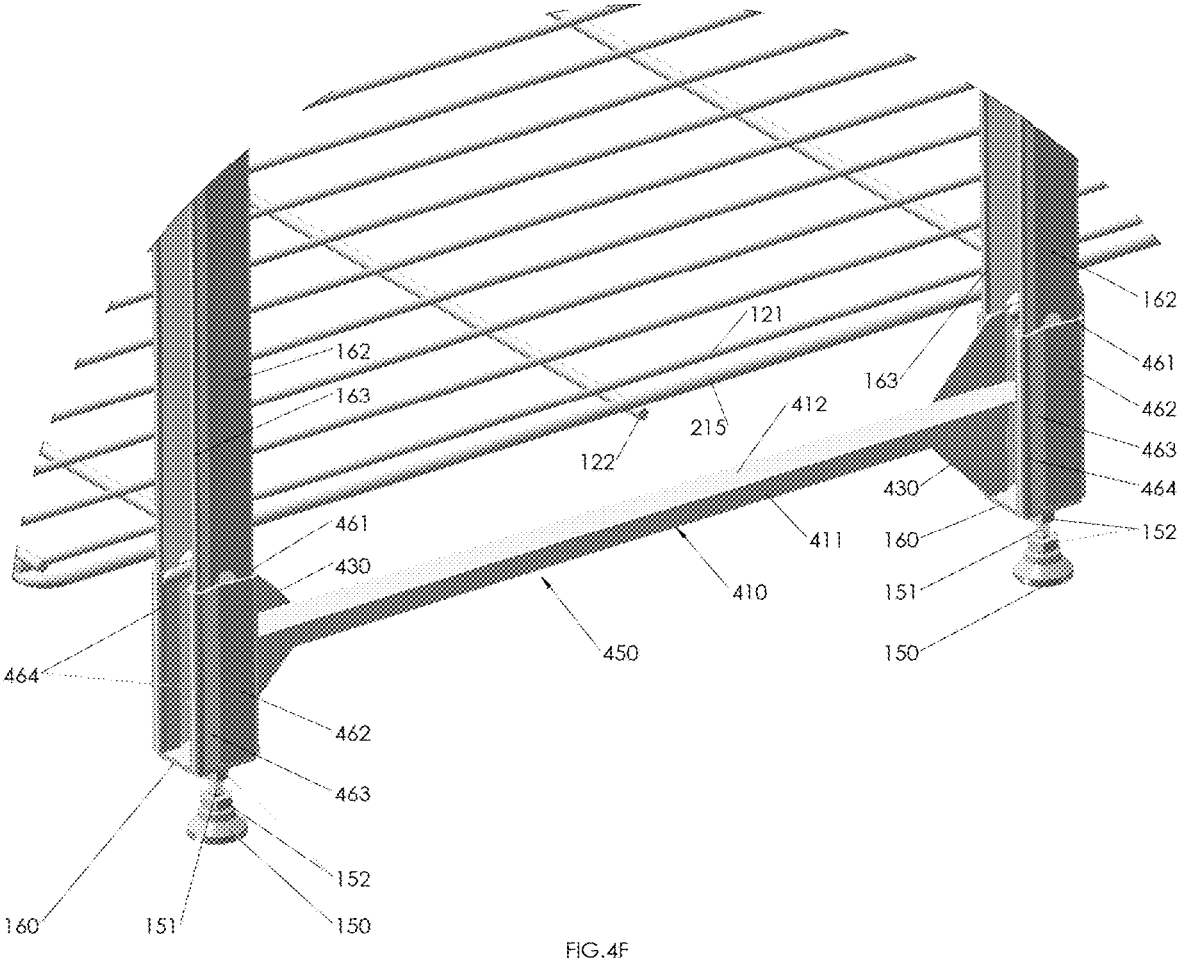

FIG. 4D shows a third embodiment of a cross-member 450 suitable for use in conjunction with uprights 105 of the present disclosure. Cross-member 450 includes bar 410 having a vertical portion 411 and a horizontal portion 412, with vertical portion 411 and horizontal portion 412 substantially perpendicular to each other, and a plurality of support elements 430 similar to those shown in FIG. 4A. In the embodiment shown in FIG. 4D, cross-member 450 includes a pair of "U"-shaped end brackets 460. Each end bracket 460 each includes an end wall 461, a first angled surface 462, a second angled surface 463, and an end loop 464. End wall 461 is sized and configured to match flat section 164 of upright 105. Each first angled surface 462 is sized and configured to match leg 162. Each second angled surface 463 is angled away from first angled surface 462 so that end loop 464 can matingly engage hem 163. The structures and relationships are better seen in FIGS. 4E-4F. In the embodiment shown in FIGS. 4D-4F, end wall 461 includes a pair of lock tabs 465. Lock tabs 465 have a shape, i.e., a curved edge 466 designed and configured to match curved surface 467 of opening 115. To place cross-member 450 on uprights 105, end brackets 460 are placed over upright 105 so that end loops 464 engage hems 163. Thereafter, cross-member 450 is slid along upright to the desired position. Then, lock tabs 465 may be bent slightly inward to engage curved bottom edge of opening 115. Alternatively, lock tabs 465 may be omitted and a pin (not shown) of suitable size and shape can be inserted through an opening in end bracket (not shown) and into opening 115.

Figure 5:
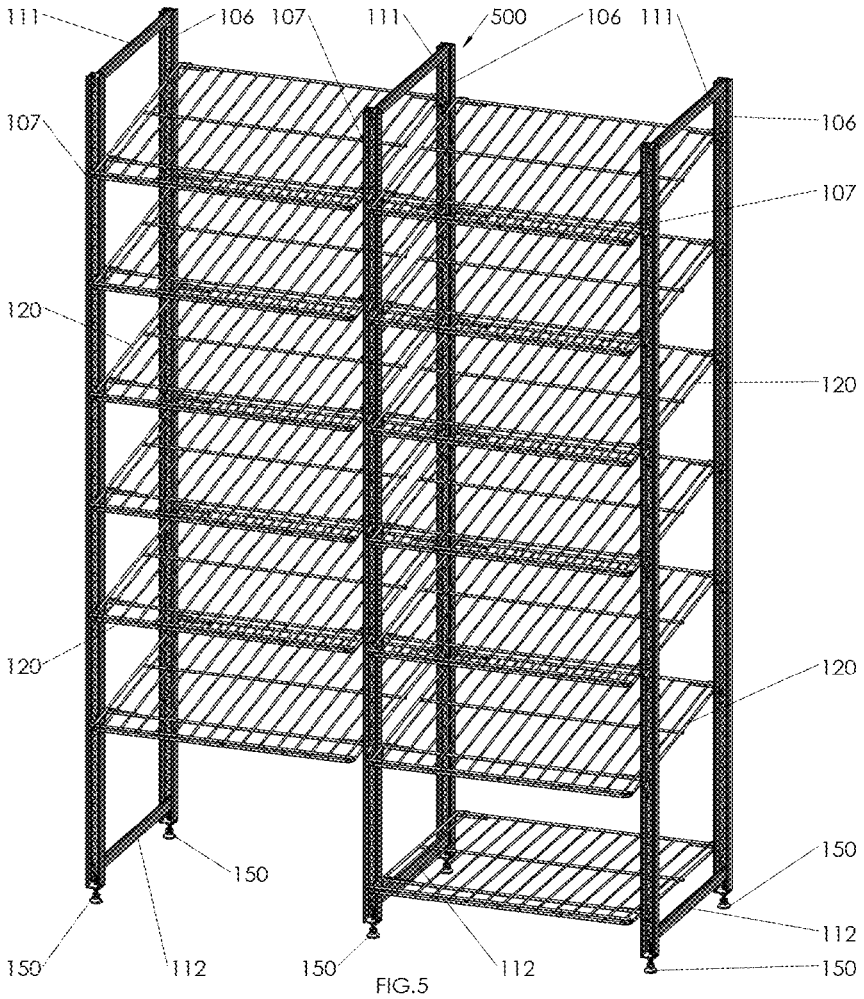
FIG. 5 shows a front perspective view of a side-by-side configuration of two assembled in-door cooler rack shelving systems according to the present disclosure.

FIG. 5 shows a front perspective view of a system 500 according to the present disclosure. System 500 is comprised of two systems 100 substantially as shown in FIG. 1. All of the elements shown in system 500 have been previously described in detail with respect to other Figures. Of note with respect to system 500, the purpose of parallel rows of slots 115 becomes apparent: each parallel row of slots 115 can accommodate prongs 130, 131, 225 of individual wire shelves 120 such that system 500 can be expanded to accommodate any width of the cooler as necessary.

FIG. 6 shows a front perspective view of a system 600 according to the present disclosure. A system 600 is comprised of two systems 100 substantially as shown in FIG. 1. Again, all of the elements shown in system 600 have been previously described in detail with respect to other Figures with the exception of extended wire shelf 610. Extended wire shelf 610 includes all of the same individual elements as described previously with respect to FIGS. 2 and 2A, but extended wire shelves 610 comprises longer longitudinal wires 121 such that wire edge 205 extends beyond rear uprights 106. In the alternative embodiments of system 100, two different depths of wire shelves 120, 610 can be provided, i.e., 26" and 36", to accommodate different size/quantities of merchandise. Although two different wire shelves 120, 610 depths can be provided, only one configuration of upright 105 and only one length of cross-member 110 will be needed. As a result, uprights 105 will be in the same relative locations when using either shelf 120, 610.

Figure 7:
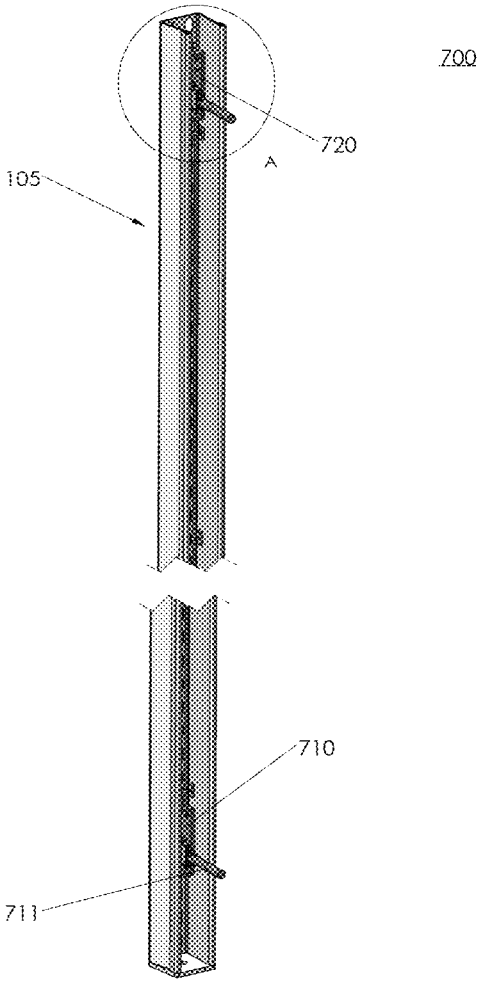
FIG. 7 shows a power supply and data transfer attachment for an in-door cooler rack shelving system according to the present disclosure.
Figure 7A:
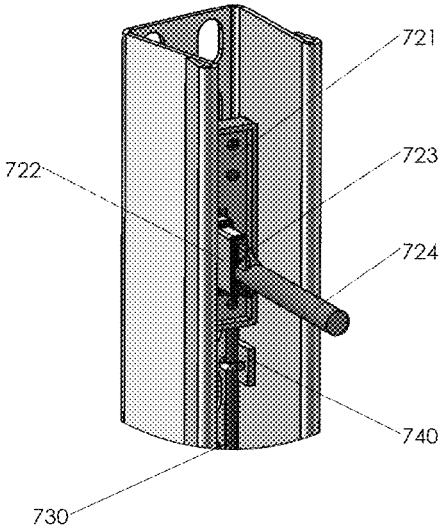
FIG. 7A is a detail view of section "A" of FIG. 7.

FIG. 7 shows a power supply and data transfer system 700 ("system") installed inside of upright 105. System 700 comprises an input box 710 located proximal bottom of upright 105, an outbox 720 located proximal top of upright 105, and a power/data transfer cord 730 that connects input box 710 and output box 720. There are hooks 740 vertically placed along upright that hold cord 730. FIG. 7A shows output box 720 is comprised of a power supply and data transfer output box 721, a socket 722, a plug 723 and an output cord 724 that is held by cord hooks 740. Input box 710 is of a similar structure to output box 720. A PCB for power supply and data transfer is placed within output box 720 and/or input box 710. Cord 730 connects all electric elements on shelves to supply power and to collect and transfer data. Input box 710 includes input cord 711. System 700 is designed preferably to operate in conjunction with the data collection systems described in U.S. patent application Ser. No. 15/418,307 entitled "MERCHANDISE INVENTORY DATA COLLECTION FOR SHELF SYSTEMS USING LIGHT SENSORS". In operation, input cord 711 is connected to a power source, generally an AC power source, through a power adapter (not shown) that converts the AC power to a low-voltage DC power. Input cord 711 then provides low-voltage DC power to cord 730. Input cord 711 is also connected to a server (not shown) by any connection means known, such as a wired connection or a Wi-Fi connection. Input cord 711 sends data signals to the server (not shown). Cord 730 is a multi-strand cord that can transfer power and data. Output cord 724 is connected with the data collection systems such as in the above-identified U.S. patent application Ser. No. 15/418,307. Output cord 724 provides power to the data collection systems and receives inventory data therefrom. The inventory data is transferred to cord 730 which, in turn, transfers inventory data input cord 711 and, thereafter, to server (not shown) for inventory data collection and analysis.

Figure 8A:
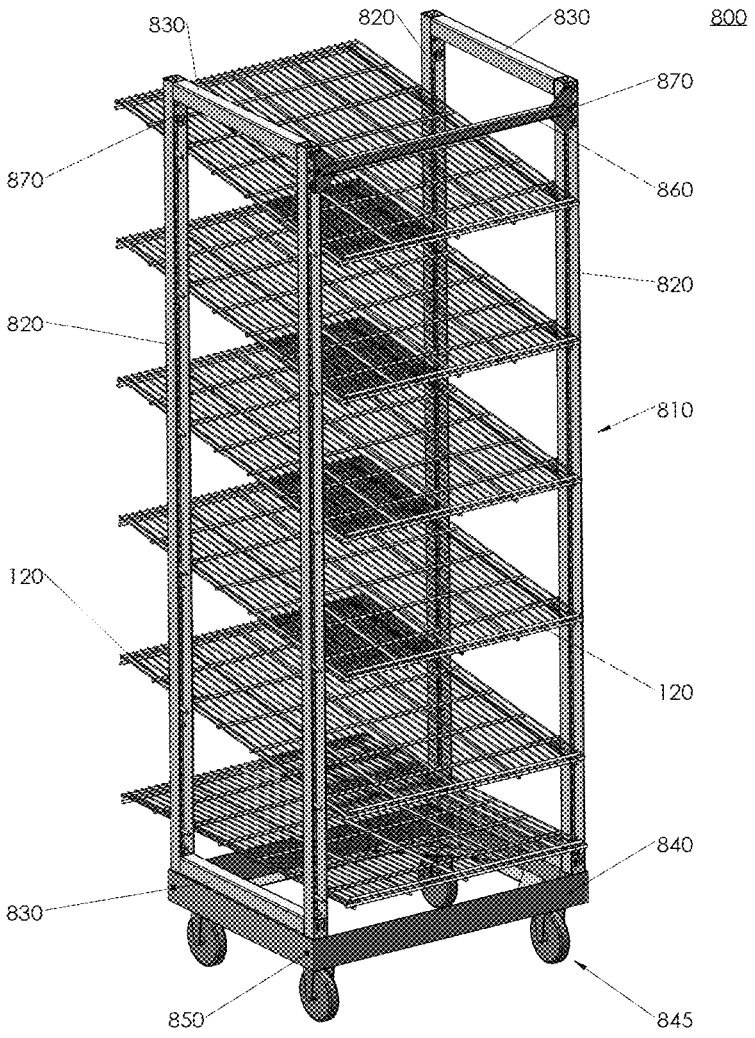
FIG. 8A shows a front right perspective view of an alternate embodiment of an in-door cooler rack shelving system according to the present disclosure.
Figure 8B:
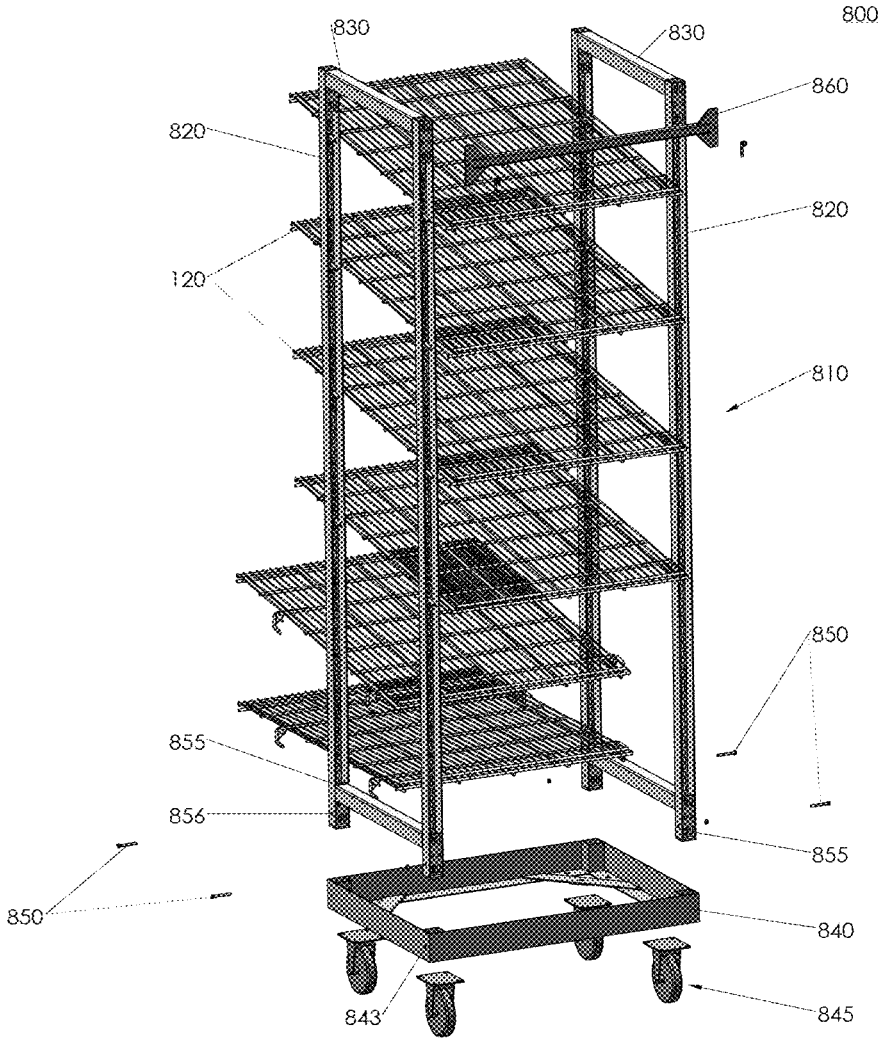
FIG. 8B shows an exploded view of the in-door cooler rack shelving system of FIG. 8A.
Figure 8C:
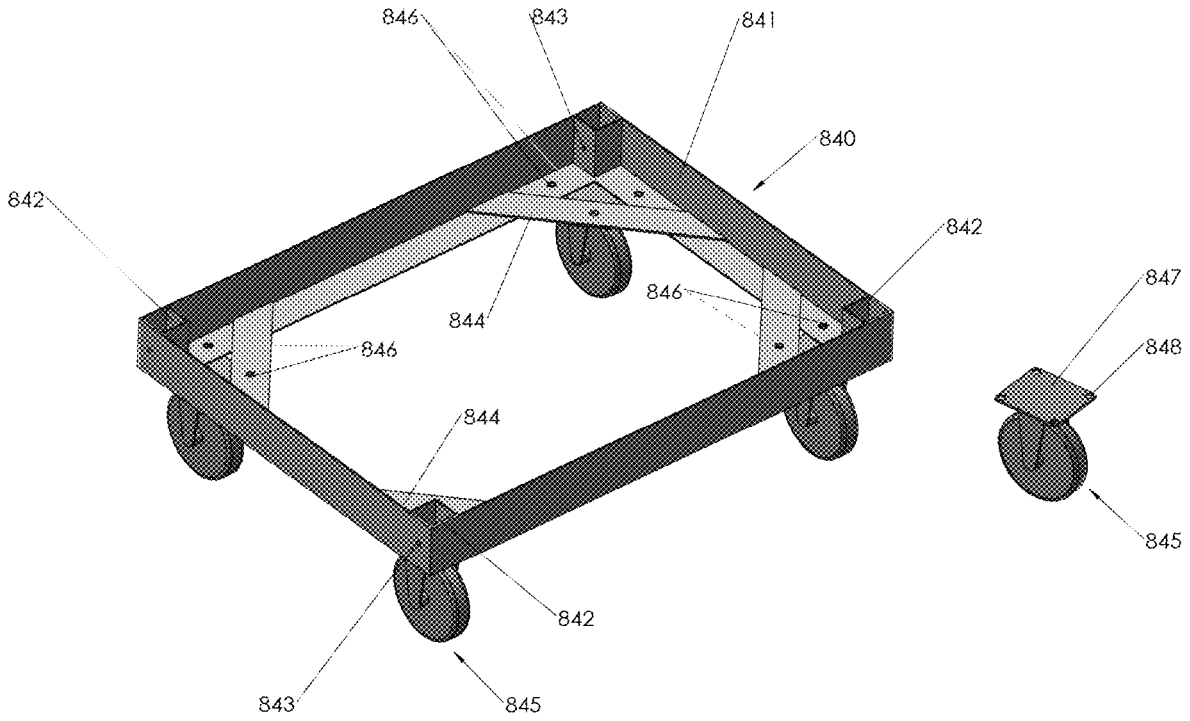
FIG. 8C shows a top perspective view of a base used in the in-door cooler rack shelving system of FIG. 8A.

FIG. 8A shows a front right perspective view of an alternate embodiment of an in-door cooler rack shelving system 800 according to the present disclosure. In FIG. 8A, in-door cooler rack system 800 is a stand-alone rack comprising two connected post-frames 810, left and right. Each connected post-frame 810 comprises a pair of vertical uprights 820 connected with a pair of cross-members 830, disposed between and proximal the top and bottom, respectively, of vertical uprights 820 to provide a depth dimension thereto. Although other materials may be used, in the embodiment shown in FIG. 8A, each vertical upright 820 and each cross-member 830 is made of a U-channel material which, as mentioned above, meet sanitation requirements of the food and beverage industry. Vertical uprights 820 and cross-members 830 may be connected in any way desired but are preferably all welded together. Welding serves at least two purposes: welded post-frames 810 greatly increase the stiffness and stability of system 800 as well as sealing against any possible open areas where vertical uprights 820 are connected to the horizontal cross-members 830. This latter feature serves to eliminate sites that can trap spillage, etc. and could propagate bacterial growth. The two connected post-frames 810 are disposed on a base frame 840 which will be described in more detail in conjunction with FIGS. 8B and 8C. Base frame 840 includes four (4) wheels 845 that are preferably designed and constructed to be capable of bearing the weight of merchandise on fully loaded shelves 120 as well as the weight of system 800. System 800 also includes cross-brace(s) 860 (see, FIGS. 8D-8G) and wire shelves 120, 610. In addition, each vertical upright 820 has a keyhole plate 870 proximal each end of vertical upright 860 on the open side of U-channel (see, FIG. 8B). Each keyhole plate 870 has keyholes 440 disposed therein. In the embodiment of system 800 shown in FIG. 8A, there is a single cross-brace 860 disposed between adjacent post frames 810. Due to the welded structure of post-frames 810 and the use of base frame 840 and single cross-brace 860, no rear connection is needed, and the absence of a rear connection avoids blocking access to the rear of shelves 120 during merchandise stocking or refilling since the spacing between two shelves is frequently tight. Although not shown, each post frame 810 can also include keyholes proximal each end of vertical upright 820 on the closed side of the U-channel and adjacent to slots 115. Post-frames 810 are connected to base frame 840 using bolts 850 (see, FIG. 8B). FIG. 8B shows an exploded view of the in-door cooler rack shelving system 800 of FIG. 8A. In FIG. 8B it is seen that vertical uprights 820 of post-frames 810 extend beyond lower cross-members 830 to create a sort of "leg" 855 having a through-hole 856, the purpose of which will become clear in conjunction with FIG. 8C. FIG. 8C shows a top perspective view of base frame 840 used in the in-door cooler rack shelving system 800 of FIG. 8A with post-frames 810 removed. Base frame 840 comprises four (4) L-rods 841 connected at substantially right-angle junctions to one another to form a square- or rectangular-like shape. Disposed at each junction is a steel tube 842 that is sized and configured to accept leg 855 of post-frame 820. The height of steel tube 842 substantially matches that of L-rod 841. One bolt 850 is used to lock leg 855 into steel tube 842. Each steel tube 842 has a through-hole 843 that passes through steel tube 842 and is aligned with through-hole 843 on L-rod 841. Through-holes 843 and 856 are designed and configured to also align to accept bolt 850 therethrough to lock post-frames 810 into base frame 840. At each corner of base frame 840 is a brace 844 disposed at approximately a 45-degree angle to opposing L-rods 841. In addition, there are four base holes 846 disposed proximal each corner of base frame 840, two on the edges of L-rods 841, one on brace 844 and the forth not visible on each L-rod 841 inside steel tube 842. Each wheel 845 includes a top plate 847, and each top plate 847 includes top plate holes 848 disposed and configured to align with base holes 846. The top plate holes 848 and base holes 846 are designed to accept bolts (not shown) to lock top plate 847 onto base frame 840.

Figure 8F:
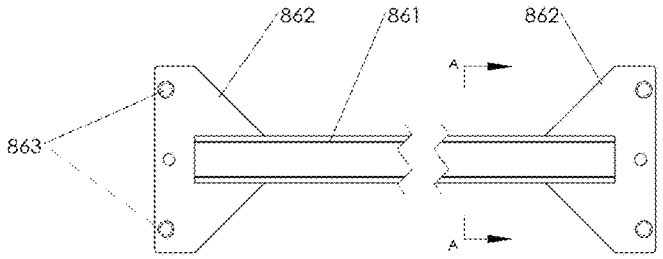
FIGS. 8D-8G show various views of a cross-brace according to an alternate embodiment of the present disclosure.
Figure 8E:
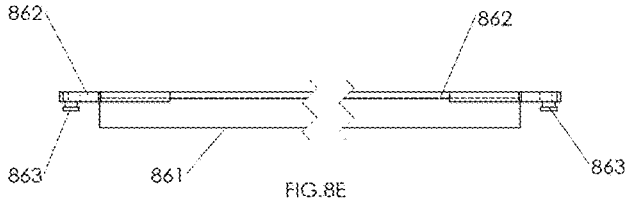
Figure 8G:
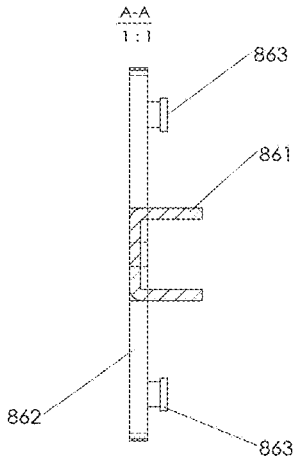
Figure 8D:
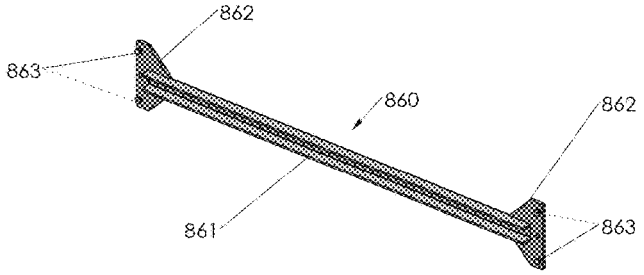

FIGS. 8D-8G show details of cross-brace 860. Cross-brace 860 includes U-channel arm 861, end plates 862 and raised tabs 863. FIG. 8E shows a top view of cross-brace 860. FIG. 8F shows a rear view of cross-brace 860. FIG. 8G shows a cross-sectional view of cross-brace 860 through line "A"-"A" of FIG. 8F. As will be apparent based on the previous detailed descriptions, U-channel arm 861 is designed and configured to cause raised tabs 863 to be aligned for mating with keyholes 440 on vertical upright 820.

Figure 9A:
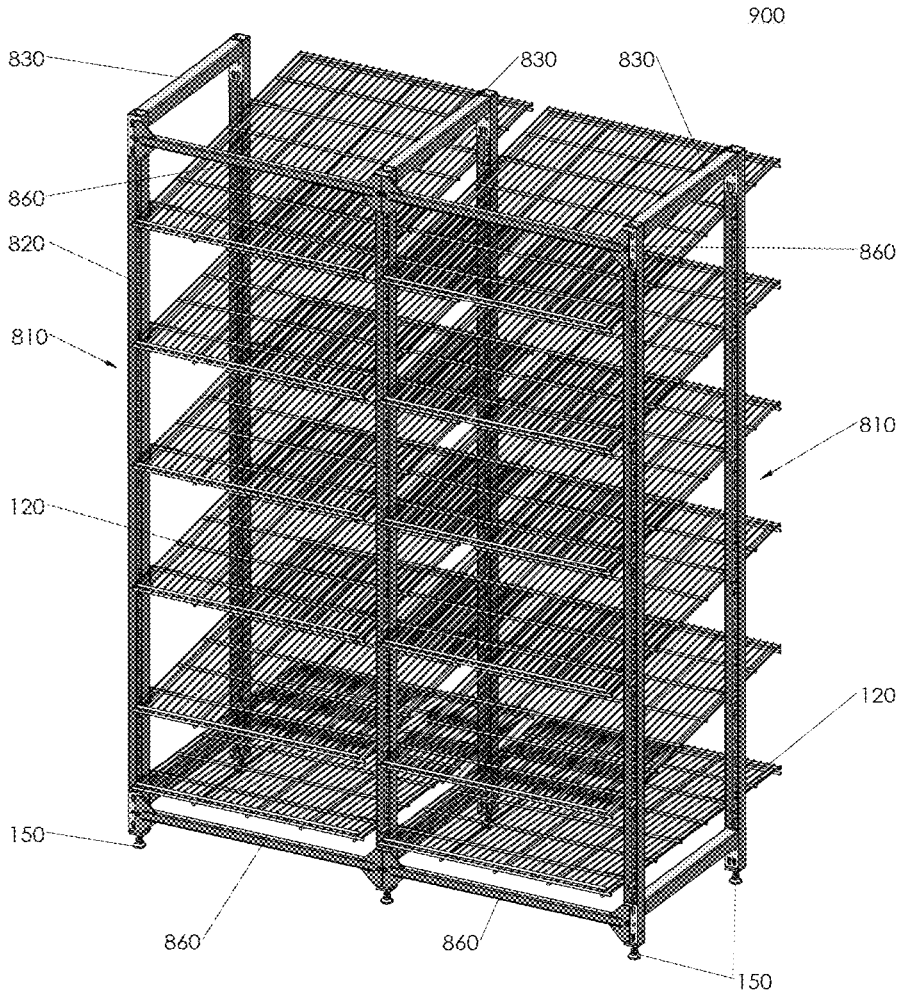
FIG. 9A shows a left front perspective view of another alternate embodiment of an in-door cooler rack system according to the present disclosure.
Figure 9B:
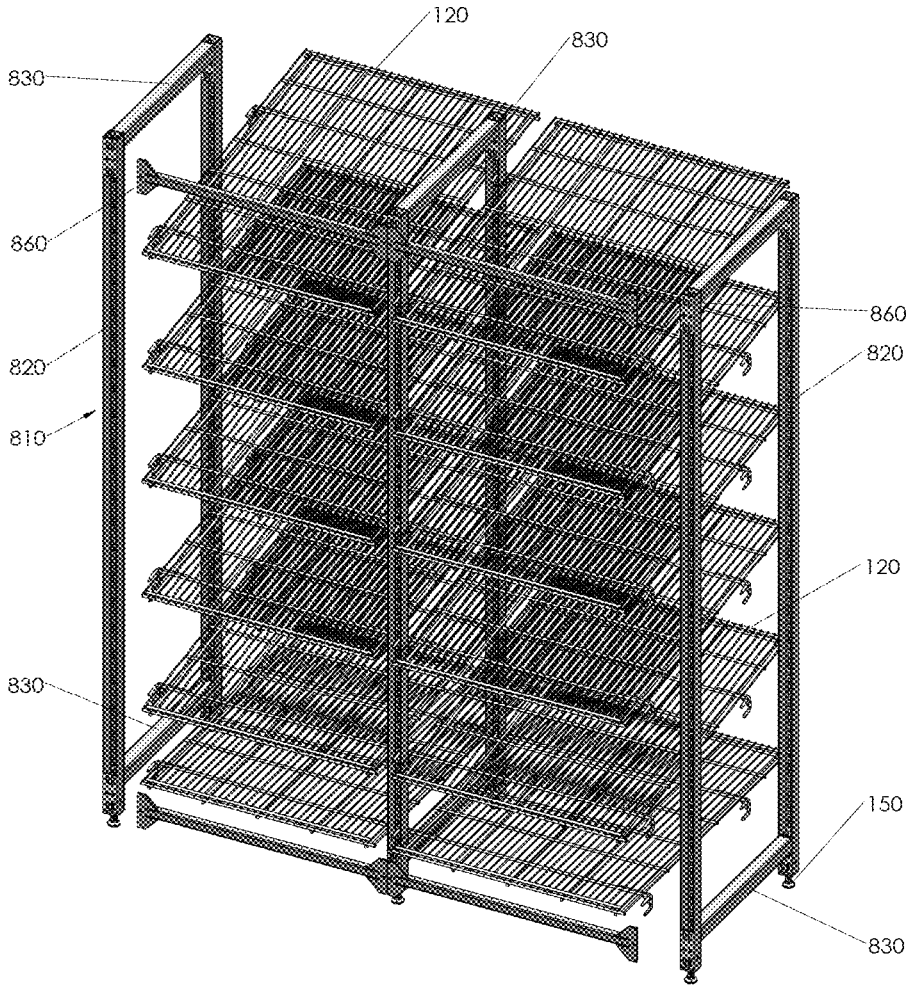
FIG. 9B shows an exploded view of the in-door cooler rack shelving system of FIG. 9A.

FIG. 9A shows a left front perspective view of another alternate embodiment of an in-door cooler rack system 900 according to the present disclosure. FIG. 9B shows an exploded view of the in-door cooler rack system 900 of FIG. 9A. All components of FIGS. 9A and 9B have been previously described. FIGS. 9A and 9B show multi-rack system 900 comprising a plurality of post-frames 810 connected and linked together side by side using cross-braces 860. Different from the single rack system 800 as showed in FIGS. 8A-8C, there is no base-frame 840. Instead, post-frames 810 are connected in the front by top and bottom cross-braces 860 without using cross-braces 860 in the rear. Adjustable feet 150 is connected to each leg 855. Adjustable feet 150 are used to support all merchandise loading and for leveling system 900.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made, and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

All of the patents and patent publications referred to herein are Incorporated herein by reference as if fully set forth verbatim in this disclosure.

What is claimed is:

1. A stand-alone in-door cooler rack shelving system comprising:

at least four uprights comprising a pair of front uprights and a pair of rear uprights, wherein each upright comprises a plurality of openings arranged in at least one row along a length of each upright;

at least two cross-members, wherein a first said cross-member is disposed between a first front upright and a first rear upright to form a first shelf support, and wherein a second said cross-member is disposed between a second front upright and a second rear upright to form a second shelf support; and at least one shelf assembly removably disposed between said first and second shelf supports, wherein said shelf assembly comprises a base having two front corners and two rear corners and a plurality of connectors, wherein each connector comprises at least an upper prong and a lower prong disposed at each corner of the base and disposed away from a bottom surface of the base, wherein the upper prongs of the connectors disposed at each of the two front corners are longer than other prongs disposed on the base.

2. The system according to claim 1, wherein each of said at least four uprights comprise openings sized and configured to matingly engage a protrusion on each end of the cross-members.

3. The system according to claim 1, wherein each of the plurality of openings has a shape selected from the group consisting of oval, square and circular.

4. The system according to claim 1, wherein the plurality of openings is arranged in two parallel rows along the length of each upright.

5. The system according to claim 4, wherein the openings in each parallel row is spaced substantially equidistant from each adjacent opening in the row.

6. The system according to claim 1, wherein at least some of the openings are identified with a marking.

7. The system according to claim 4, wherein openings at a same position along the length of each parallel row are identified with the same marking.

8. The system according to claim 1, wherein adjacent openings along the length of each of said at least four uprights are spaced approximately ¾" on center.

9. The system according to claim 2, wherein the protrusion is selected from the group consisting of a spring-loaded clip, a raised tab disposed on a post and a lock tab.

10. The system according to claim 1, further comprising a support at the end of each of said at least four uprights selected from the group consisting of an adjustable foot, a roller and a wheel.

11. The system according to claim 1, wherein each of said at least four uprights comprises an open tubular configuration.

12. The system according to claim 11, wherein the open tubular configuration is selected from the group consisting of a C-shape having an angled surface with a hem and a U-shape having rectangular side walls without a hem.

13. The system according to claim 1, wherein said at least one shelf assembly comprises a wire shelf having a top surface and a bottom surface, wherein the wire shelf is comprised of a plurality of longitudinal wires and a plurality of support wires disposed substantially perpendicular to the plurality of longitudinal wires.

14. The system according to claim 13, wherein each upper prong and each lower prong is sized and configured to engage an opening of the plurality of openings in the first front and rear uprights or the second front and rear uprights.

15. The system according to claim 14, wherein each lower prong comprises an extension, and wherein an extension is attached to each of a first end and a second end of at least two of said support wires.

16. The system according to claim 15, wherein each of said extensions is reinforced.

17. The system according to claim 1, wherein each prong is angled downwardly away from the shelf assembly.

18. The system according to claim 1, wherein each upper prong and each lower prong at each corner of the base are affixed to said base.

19. The system according to claim 1, wherein each of said at least two cross-members disposed between said front uprights and said rear uprights is connected to said front upright and said rear upright by welding.

20. The system according to claim 19, wherein said at least two cross-members comprises at least four cross-members, wherein two cross-members are disposed between said first front upright and said first rear upright, wherein two cross-members are disposed between said second front upright and said second rear upright, and wherein each of said at least four cross-members is connected to said front uprights and said rear uprights by welding.

21. The system according to claim 1, further comprising a cross-brace disposed between said first front upright and said second front upright, or disposed between said first rear upright and said second rear upright.

22. The system according to claim 1, wherein said at least four uprights comprises at least six uprights comprising three front uprights and three rear uprights, wherein the plurality of openings is arranged in two parallel rows along the length of each upright, wherein the at least two cross-members comprises at least three cross-members, wherein the first said cross-member is disposed between the first front upright and the first rear upright to form a first shelf support, wherein the second said cross-member is disposed between the second front upright and the second rear upright to form a second shelf support, wherein the third said cross-member is disposed between the third front upright and the third rear upright to form a third shelf support, wherein the at least one shelf assembly comprises at least two shelf assemblies, wherein each said shelf assembly comprises a base having a plurality of connectors, wherein each connector comprises at least an upper and a lower prong at each corner of the base and disposed away from a bottom surface of the base, wherein a first shelf assembly is removably disposed substantially perpendicular between said first and second shelf supports, and wherein a second shelf assembly is removably disposed substantially perpendicular between said second and said third shelf supports.

23. The system according to claim 22, further comprising a cross-brace disposed in a location selected from at least one of the group consisting of: between said first front upright and said second front upright, between said second front upright and said third front upright, between said first rear upright and said second rear upright, and between said second rear upright and said third rear upright.

24. A stand-alone in-door cooler rack shelving system comprising:

at least four uprights comprising a pair of front uprights and a pair of rear uprights, wherein each upright comprises a plurality of openings arranged in at least one row along a length of each upright;

at least two cross-members, wherein a first said cross-member is disposed between a first front upright and a first rear upright to form a first shelf support, and wherein a second said cross-member is disposed between a second front upright and a second rear upright to form a second shelf support; and at least one shelf assembly removably disposed between said first and second shelf supports, wherein said at least one shelf assembly comprises a wire shelf having a top surface and a bottom surface having two front corners and two rear corners, wherein the wire shelf is comprised of a plurality of longitudinal wires and a plurality of support wires disposed substantially perpendicular to the plurality of longitudinal wires, wherein said wire shelf comprises a plurality of connectors, wherein each connector comprises at least an upper and a lower prong at each corner of the base and disposed away from the bottom surface, wherein each prong is sized and configured to engage an opening of the plurality of openings in the first front and rear uprights and the second front and rear uprights, and wherein each lower prong comprises an extension attached to a first end and a second end of at least two of said support wires.

25. The system according to claim 24, wherein the upper prong at each front corner is longer than all the lower prongs and the upper prongs disposed at each rear corner.

* * * * *